US005314067A

United States Patent [19]

Strock

[11] Patent Number: 5,314,067

[45] Date of Patent: May 24, 1994

[54] BOTTLE CONNECTION SYSTEM

[76] Inventor: Sara Strock, 765 Mohawk Hills Dr. Apt. C, Carmel, Ind. 46032

[21] Appl. No.: 897,803

[22] Filed: Jun. 12, 1992

[51] Int. Cl.[5] ..... B65D 65/00

[52] U.S. Cl. ..... 206/430; 206/504; 206/821; 220/23.4; 220/23.83; 446/77; 446/120; 446/125

[58] Field of Search ..... 200/427, 430, 821; 220/23.4, 23.83; 446/77, 105, 120, 125, 126, 127; 206/504

[56] References Cited

U.S. PATENT DOCUMENTS

| | | | |
|---|---|---|---|
| 2,975,930 | 3/1961 | Pennington et al. | 220/23.4 |
| 3,195,723 | 7/1965 | MacDonnell et al. . | |
| 3,369,658 | 2/1968 | Hasselmann | 220/23.4 |
| 3,374,917 | 3/1968 | Troy | 220/23.4 |
| 3,386,569 | 6/1968 | Gentry . | |
| 3,577,671 | 5/1971 | Woollett | 220/23.4 |
| 3,599,828 | 8/1971 | Conway | 220/23.4 |
| 3,635,350 | 1/1972 | Wolf | 220/23.4 |
| 3,640,018 | 2/1972 | Light | 446/77 |
| 3,751,082 | 8/1973 | Somerville | 287/54 |
| 3,815,281 | 6/1974 | Kander | 220/23.4 |
| 3,878,803 | 4/1975 | Leverton | 114/0.5 F |
| 3,895,593 | 7/1975 | Moore | 114/56 |
| 4,106,657 | 8/1978 | Dogliotti | 220/23.4 |
| 4,120,396 | 10/1978 | Mascia et al. | 206/151 |
| 4,133,445 | 1/1979 | Mandelbaum | 220/23.4 |
| 4,170,082 | 10/1979 | Freedman et al. | 446/77 |
| 4,346,738 | 8/1982 | Martinek . | |
| 4,542,930 | 9/1985 | Adams | 206/427 |
| 4,624,383 | 11/1986 | Moore | 220/23.4 |
| 4,708,684 | 11/1987 | Chen | 446/127 |
| 4,764,143 | 8/1988 | Gat et al. | 446/120 |
| 4,804,350 | 2/1989 | Chen | 446/127 |
| 4,860,896 | 8/1989 | Snider | 206/407 |
| 4,886,239 | 12/1989 | Stimmel | 220/23.4 |
| 4,919,296 | 4/1990 | Kirsh et al. | 220/23.4 |
| 4,940,141 | 7/1990 | Philpot | 206/430 |
| 4,982,858 | 1/1991 | von Holdt | 220/23.4 |
| 5,020,175 | 6/1991 | Kirkpatrick | 5/448 |
| 5,050,755 | 9/1991 | Strawder | 220/23.83 |
| 5,054,617 | 10/1991 | Young et al. | 206/509 |
| 5,120,253 | 6/1992 | Gelardi | 446/77 |
| 5,148,932 | 9/1992 | Orefice | 220/23.4 |
| 5,180,323 | 1/1993 | Justice | 446/125 |

FOREIGN PATENT DOCUMENTS

| | | | |
|---|---|---|---|
| 2608066 | 6/1988 | France | 446/127 |

*Primary Examiner*—David T. Fidei
*Attorney, Agent, or Firm*—Baker & Daniels

[57] ABSTRACT

A connection system adapted to be used with cylindrical containers includes a sleeve which is adapted to frictionally engage either end of a cylindrical container. A recess extends orthogonally inward from the surface of the sleeve and is adapted to receive a projection.

8 Claims, 3 Drawing Sheets

BOTTLE CONNECTION SYSTEM

FIELD OF THE INVENTION

This invention relates to an apparatus for converting discardable generally cylindrical containers into useful things, and, in particular, to an apparatus for interlocking generally cylindrical containers in a plurality of desired relative positional relationships therebetween.

BACKGROUND OF THE INVENTION

The discarding of all kinds of waste and the associated effects on the environment is of increasing concern. As one part of the solution to the waste problem, a multiplicity of methods and apparatus for recycling various types of waste have been proposed. The recycling of soft drink bottles and cans may be divided into two distinct approaches. First, the material forming the can or bottle, i.e., the aluminum or plastic material, may be reformulated, such as by melting, and used to form other useful devices. Second, the used cans or bottles may be used to form other useful structures. The present invention is directed to the latter type of method and apparatus.

U.S. Pat. No. 5,020,175 to Kirkpatrick, et al. discloses an apparatus using a plurality of plastic soft drink bottles to form an alternative useful structure from the soft drink bottles. A cushion is provided which is adapted to receive a plurality of soft drink bottles in a serial manner to form alternative useful structures such as a raft, surfing device, storage and moving mat, or the like. The soft drink bottles are not actually interconnected within the mattress but are instead used to provide rigidity and/or flotation.

U.S. Pat. No. 4,860,896 to Snider discloses a device for creating useful, entertaining and imaginative structures from beverage containers such as aluminum cans. An annular ring having a plurality of interfitting projections is provided and allows the pop cans to be connected in a serial, parallel or criss-cross manner. Such an apparatus does not include an annular web having a recess formed therein or a projection interfitting with a recess in the web allowing interconnection of the cans. Moreover, such a device does not allow the end of a can to be connected orthogonally to the exterior surface of the device.

What is needed in the art is a system which allows cans or bottles to be connected at a multiplicity of desired positional relationships therebetween, such as serial, parallel, criss-cross or orthogonal interconnection, and thereby forms a decorative or imaginary structure providing an alternative use for the cans or bottles.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, and such exemplification is not to be construed as limiting the scope of the invention in any manner.

SUMMARY OF THE INVENTION

The present invention is directed to a sleeve having inner and outer surfaces and a recess formed therein for receiving a projection.

Generally, a recess is formed in or fixed to a sleeve which is adapted to frictionally engage either end of a soft drink bottle. The recess is adapted to engage a projection formed in or fixed to an adjacent sleeve, a tapered end of a soft drink bottle, or the like.

The invention comprises, in one form thereof, a connection system adapted to be used with cylindrical containers. A sleeve is adapted to frictionally engage either end of a cylindrical container. A recess extends orthogonally inward from the surface of the sleeve and is adapted to receive a projection.

In another form of the invention, a projection extends orthogonally outward from the surface of the sleeve.

An advantage of the present invention is that the plurality of cans or bottles may be interconnected therebetween at a plurality of angles such as serial, parallel, criss-cross or orthogonal interconnections.

Another advantage of the present invention is that the device may be easily modified for use with a plurality of different sized cans or bottles.

Yet another advantage of the present invention is that the tapered end of a soft drink bottle may be connected to the device either serially or orthogonally.

A still further advantage of the present invention is that the sleeve may be formed from a plastic sheet with opposing edges which is vacuum or injection molded to produce the projection and recess and the opposing edges connected together, thereby reducing manufacturing costs.

DETAILED DESCRIPTION

Figure 2:
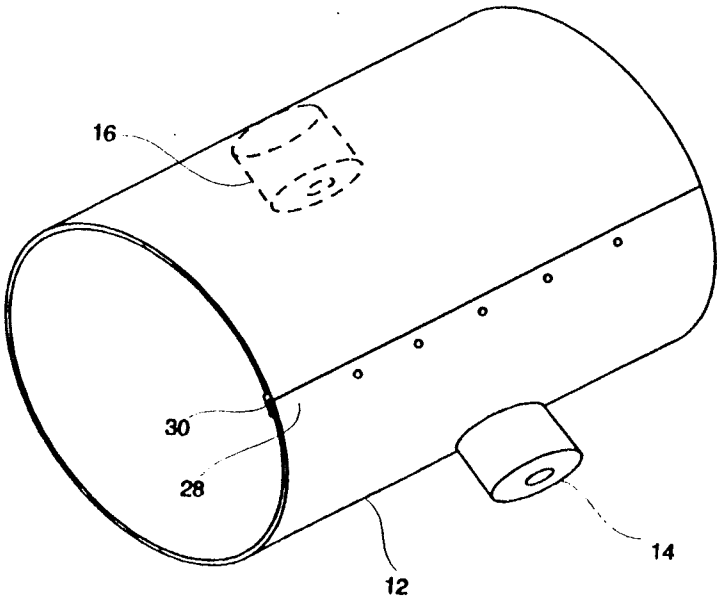
FIG. 2 is a perspective view of the present invention when not installed on a bottle.
Figure 1:
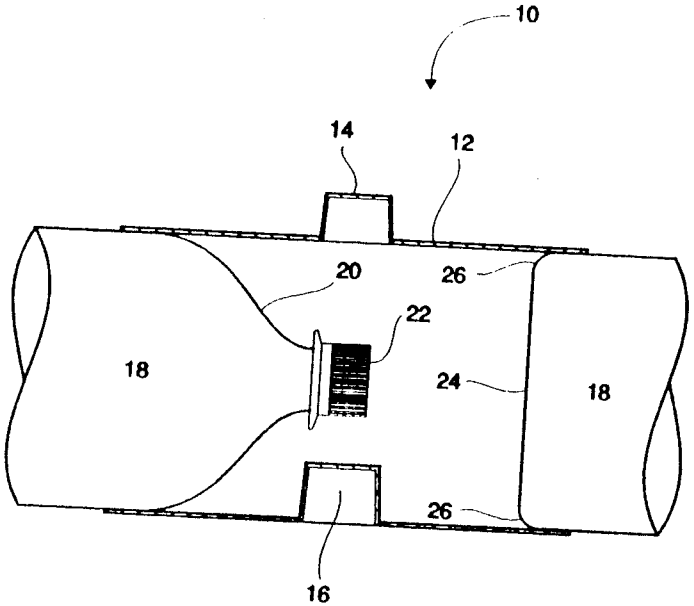
FIG. 1 shows a side sectional view of the present invention when installed on either end of a bottle.

Referring now to the drawings and particularly to FIGS. 1 and 2, there is shown a bottle connection system 10 of the present invention. Bottle connection system 10 generally includes a sleeve 12 having a projection 14 and recess 16 fixed to or formed therein.

Sleeve 12 is adapted or sized to frictionally engage either end of generally cylindrical containers 18. In the embodiment shown, cylindrical containers 18 are plastic soft drink bottles having a tapered pouring end 20 with a removable cap 22 fixed thereto. A base end 24 is disposed opposite of tapered pouring end 20 and includes a slightly rounded periphery 26. Thus, sleeve 12 may be slid over either end of and frictionally engage soft drink bottles 18. A removable cap 22 is preferably maintained on each soft drink bottle 18 to maintain rigidity and prevent radial deformation of the soft drink bottles 18. The external periphery of sleeve 12 may be adapted to receive advertising slogans such as the name of a soft drink manufacturer or a particular product.

Plastic sleeve 12 includes two opposite edges 28 and 30 (FIGS. 2 and 3) which may be slightly overlapped and fixed to each other by, e.g., epoxy, rivets or welding with high frequency sound waves.

Formed in or fixed to the surface radially inner of sleeve 12 is an inwardly extending recess 16 adapted to receive a projection 14. Recess 16 may be tapered or generally cylindrical in shape and may be disposed at any desired axial location on sleeve 12 not interfering with the above described frictional fit with soft drink bottles 18. In the embodiment shown, recess 16 is located at a position about one-half the length of sleeve 12. However, recess 16 can be located at any convenient position on sleeve 12.

Projection 14 extends outwardly from and is orthogonal to the radially outer surface of sleeve 12 and may be fixed thereto or formed therein. In the embodiment shown, projection 14 is disposed opposite of and co-axially with recess 16. However, it may be desirable in certain applications to dispose projection 14 at a location other than co-axially with recess 16. If projection 14 and recess 16 are disposed coaxially with each other, the center line distance therebetween should be one-half of the circumference of plastic sleeve 12 when assembled with edges 28 and 30 affixed to each other.

In the embodiment shown, projection 14 has a base diameter of about 1.209 inches and an outer end diameter of about 1.187 inches; and recess 16 has a base diameter of about 1.209 inches and an outer end diameter of about 1.172 inches. Thus, projection 14 and recess 16 are slightly tapered from the base to the outer end. Moreover, projection 14 is formed with an outer end having a slightly larger diameter than the outer end of recess 16, thereby forming a friction fit when a projection 14 is engaged in a recess 16.

Alternative methods of frictionally engaging projection 14 with recess 16 (not shown) include, e.g., forming a recess having an outer end diameter which is slightly less than the outer end diameter of the projection, or forming a projection which is generally cylindrically shaped and a recess which is slightly tapered and has an outer end diameter slightly less than the diameter of the projection. Moreover, in certain applications it may not be necessary or desirable to provide frictional engagement between the recess and projection.

Formed at the outer end of recess 16 is an opening 32 (FIGS. 2 and 3) allowing air to flow to the ambient environment upon insertion of projection 14 into recess 16. That is, since projection 14 and recess 16 are formed to provide a frictional fit therebetween, it may be desirable to provide an opening 32 in recess 16 and thereby prevent formation of compressed air therebetween to allow air to escape. Moreover, an opening 32 may not be required depending on the construction of projection 14 and recess 16.

Figure 3:
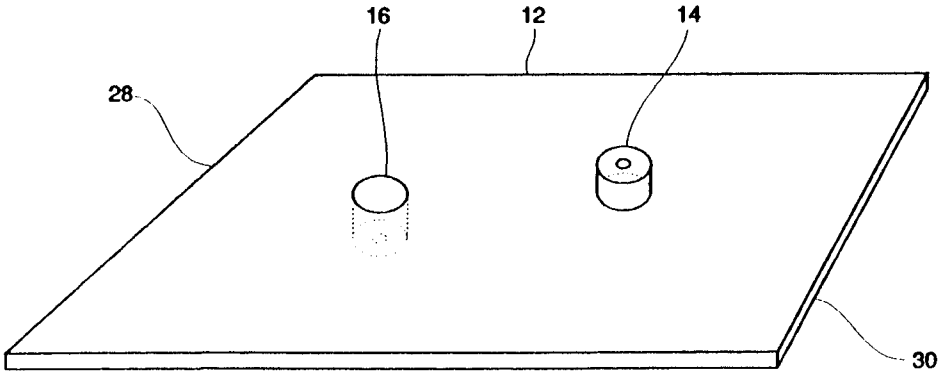
FIG. 3 is a perspective view of a plastic sheet which may be used to form the plastic sleeve which has a projection and recess formed therein.

FIG. 3 illustrates the positional relationship of projection 14 and recess 16 formed in plastic sheet 12 prior to affixation of edges 28 and 30 to each other as described above. In the embodiment shown, sleeve 12 is formed from relatively rigid but slightly flexible plastic, allowing sleeve 12 to maintain a generally cylindrical shape when in place on soft drink bottles 18, but capable of resiliently withstanding moderately applied radial forces. More particularly, sleeve 12 is formed from polystyrene having a thickness of about 30 mils (i.e., 0.030 inch). It is to be understood, however, that sleeve 12 could be formed from other suitable materials.

In the embodiment shown, projection 14 and recess 16 are formed in plastic sleeve 12 using a conventional vacuum forming process. However, it is to be understood that projection 14 and recess 16 could be formed in plastic sheet 12 using other manufacturing methods, e.g., by injection molding or attaching a separately formed projection 14 and recess 16 to plastic sheet 12.

Figure 4:
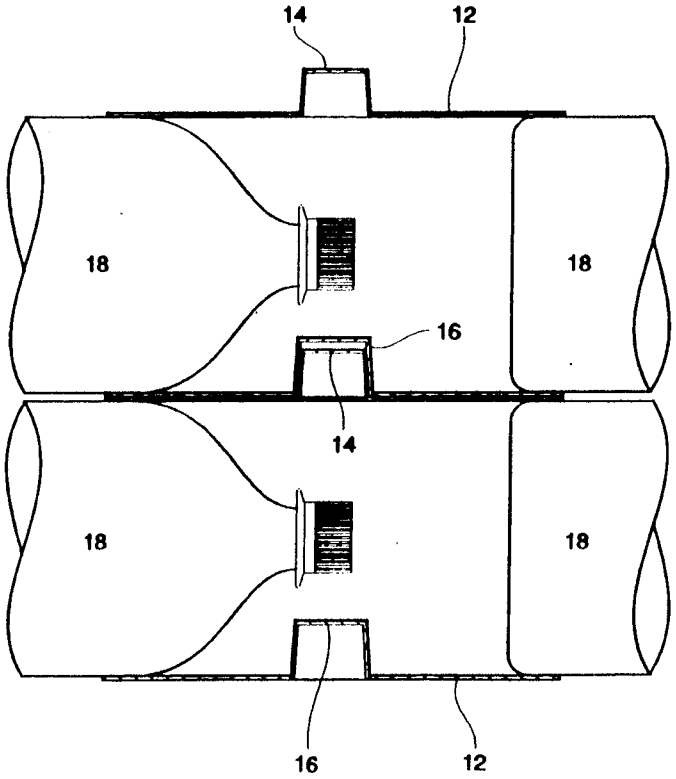
FIG. 4 is a side sectional view of two sleeves having a recess and projection formed therein which are connected in parallel to each other and at each end thereof to a plastic soft drink bottle.

FIG. 4 illustrates both serial and parallel connection of soft drink bottles 18 using the bottle connection system 10 of the present invention. As described above, sleeve 12 is adapted to frictionally engage and thereby provide serial end-to-end connection of bottles 18. Moreover, recess 16 may be formed to frictionally engage a projection 14 formed in another adjacent sleeve 12. In this manner, bottles 18 may be connected in parallel to form a generally planar structure such as a vertical wall, horizontal ceiling or the like. It is thus apparent that soft drink bottles 18 may be interconnected to provide, e.g., a wall having desired dimensions.

Figure 5:
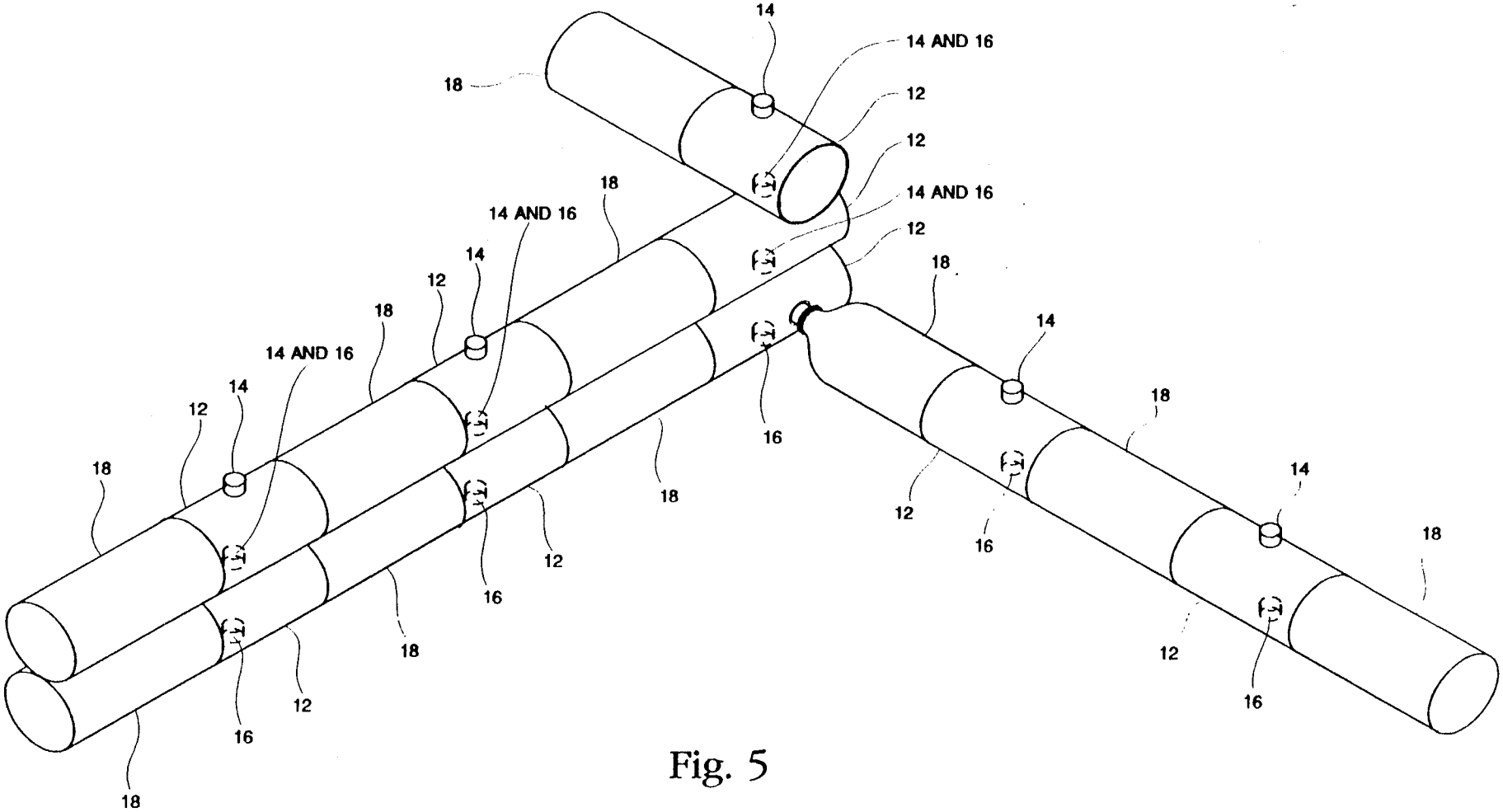
FIG. 5 illustrates various configurations in which the bottles may be interconnected to each other with the present invention, including serial, parallel, criss-cross and orthogonal interconnection.

FIG. 5 illustrates a plurality of ways in which bottles 18 may be connected to each other using the bottle connection system 10 of the present invention. As indicated in FIG. 5 and described above with regard to FIG. 4, bottles 18 may be connected in a serial or parallel manner. Moreover, as shown, bottles 18 may also be connected in a criss-cross manner if desired for a particular application. The criss-cross interconnection can form an orthogonal, acute or obtuse angle between the bottles 18.

In the embodiment shown, projection 16 is formed with a shape similar to a removable cap 22 shown in FIG. 1. Recess 16 can then be formed to either engage a projection 16 or a removable cap 22 of a tapered pouring end 20. In this manner, not only can serial, parallel or criss-cross stacking be accomplished, but also a tapered end of a bottle may be connected generally orthogonal to the sleeve 12 providing right angle attachment for corners and the like. FIG. 5 illustrates a bottle 18 which is orthogonally connected at the tapered end thereof to a sleeve 12. Sleeve 12 is formed with a recess 16 which is disposed 90° from projection 14 and receives removable cap 22 of tapered end 20. Sleeve 12 may be formed with 1, 2 or more recesses, the axes of which may be disposed, e.g., 90° or 180° to each other, for receiving a projection 16, removable cap 22, or both.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A connection system comprising:

a generally cylindrical container;

a cylindrical sleeve having an axis, radially inner and outer surfaces, and opposing ends, each opposing end sized to frictionally engage either end of the cylindrical container, the inner surface frictionally engaging the cylindrical container;

a projection extending orthogonally outward from the outer surface of the sleeve, the projection having a width less than the width of the sleeve and having an axis perpendicular to the axis of the sleeve;

a recess extending orthogonally inward from the inner surface of the sleeve, the recess having a width less than the width of the sleeve and having an axis perpendicular to the axis of the sleeve; and the container further comprising a removable cap frictionally engagable with the recess of the cylindrical sleeve.

2. The connection system of claim 1 wherein the recess is coaxially disposed with the projection.

3. The connection system of claim 1 wherein the recess has a length about the same as the projection.

4. The connection system of claim 1 wherein the recess has a length slightly longer than the projection.

5. The connection system of claim 1 wherein the recess is sized to frictionally engage a projection of the size of the projection of the cylindrical sleeve.

6. The connection system of claim 1 wherein the recess is shaped to frictionally engage a projection the size of the projection of the cylindrical sleeve.

7. The connection system of claim 1 wherein the projection and the recess are tapered.

8. The connection system of claim 1 wherein the projection is generally cylindrically shaped and the recess is tapered.

* * * * *